US005939868A

United States Patent [19]

Hall et al.

[11] Patent Number: 5,939,868

[45] **Date of Patent: *Aug. 17, 1999**

[54] METHOD AND APPARATUS FOR AUTOMATICALLY CONTROLLING INTEGRATED CIRCUIT SUPPLY VOLTAGES

[75] Inventors: Jerald Nevin Hall, Scappoose; Thomas A. Rampone, Hillsboro; Kirk Tyler Byers, Portland, all of Oreg.

[73] Assignee: Intel Corporation, Santa Clara, Calif.

[ * ] Notice: This patent is subject to a terminal disclaimer.

[21] Appl. No.: 09/115,108

[22] Filed: Jul. 13, 1998

Related U.S. Application Data

[63] Continuation of application No. 08/625,798, Mar. 29, 1996, Pat. No. 5,787,014.

[51] Int. Cl.[6] ..... G05F 3/16

[52] U.S. Cl. ..... 323/281; 323/299; 323/313; 361/18; 361/56; 361/88; 361/91

[58] Field of Search ..... 323/313, 299, 323/266, 273, 314, 281; 364/528.32, 528.33

[56] References Cited

U.S. PATENT DOCUMENTS

| | | | |
|---|---|---|---|
| 4,377,781 | 3/1983 | Tatsushi et al. | 323/299 |
| 4,853,560 | 8/1989 | Iwamura et al. | 326/80 |
| 5,027,266 | 6/1991 | Ishii et al. | 363/63 |
| 5,297,261 | 3/1994 | Kuranaga | 395/284 |
| 5,319,302 | 6/1994 | Koshikawa et al. | 323/273 |
| 5,349,290 | 9/1994 | Yamada | 324/158.1 |
| 5,440,520 | 8/1995 | Schutz et al. | 365/226 |
| 5,444,298 | 8/1995 | Schutz | 257/691 |
| 5,552,698 | 9/1996 | Tai et al. | 323/313 |
| 5,552,736 | 9/1996 | Desroches | 327/198 |
| 5,563,499 | 10/1996 | Pinney | 323/266 |
| 5,570,005 | 10/1996 | Hardee et al. | 323/314 |
| 5,587,887 | 12/1996 | Price et al. | 361/794 |
| 5,590,363 | 12/1996 | Lunsford et al. | 395/800.34 |
| 5,787,014 | 7/1998 | Hall et al. | 323/281 |

*Primary Examiner*—James P. Trammell
*Assistant Examiner*—Demetra R. Smith
*Attorney, Agent, or Firm*—Blakely, Sokoloff, Taylor & Zafman

[57] ABSTRACT

A method and apparatus for automatically controlling integrated circuit supply voltages includes, according to one embodiment, a primary voltage regulator and a secondary voltage regulator. The primary voltage regulator supplies one of either a first voltage or a second voltage to a first plurality of inputs of an integrated circuit. The secondary voltage regulator conditionally supplies a third voltage to a second plurality of inputs of the integrated circuit in the event the primary voltage regulator supplies the first voltage, with the third voltage being substantially the same as the second voltage.

21 Claims, 4 Drawing Sheets

METHOD AND APPARATUS FOR AUTOMATICALLY CONTROLLING INTEGRATED CIRCUIT SUPPLY VOLTAGES

This is a continuation of application Ser. No. 08/625,798, filed Mar. 29, 1996, now U.S. Pat. No. 5,787,014.

BACKGROUND OF THE INVENTION

1. Field of the Invention

The present invention pertains to providing power to integrated circuits. More particularly, this invention relates to automatically controlling the voltage supplied to an integrated circuit.

2. Background

Technology is ever-progressing, continually providing a wide variety of integrated circuits which provide an ever-increasing variety of functions. Generally, an integrated circuit (IC), also referred to as a chip, is a combination of multiple electrical devices (such as transistors, resistors, etc.) housed together in a single package. ICs are typically mounted to a circuit board; for example, an IC may contain multiple pins and the IC is plugged into a socket on the circuit board.

Many ICs or chips require only a single voltage for operation. This single voltage is supplied to the chip via one or more of the pins which couple the chip to the circuit board. However, many different chips have evolved, resulting in different voltage requirements for different chips.

One solution to properly supplying voltages to chips with different voltage requirements would be to provide a different circuit board for each of the different chips. However, although the voltage requirements can vary from chip to chip, the remaining functions provided by the circuit board to which the chip is mounted may be the same for a wide variety of different chips. Thus, rather than having to build a separate circuit board for each of the different chips, it would be beneficial to provide a single circuit board which supports different chips having different voltage requirements. For example, such a circuit board would allow different processors with different voltage requirements to be mounted on the same circuit board.

Another solution to properly supplying voltages to chips with different voltage requirements would be to provide jumpers which allow the end user to make changes to the circuit board so that the proper voltage is supplied to the chip. However, requiring an end user to make such changes has several disadvantages. For example, such a requirement increases the work an end user must perform prior to operation of the system, reduces the "user friendliness" of the system, and increases the chances for damage to one or more components on the circuit board if the board is configured incorrectly. Therefore, it would be beneficial to provide a circuit board which automatically determines the proper voltage(s) to be supplied to a chip mounted on the circuit board.

Additionally, given the costs of modern technology, it would be beneficial to provide such automatic support in an inexpensive manner.

As will be described in more detail below, the present invention provides a mechanism for automatically controlling integrated circuit supply voltages that achieves these and other desired results which will be apparent to those skilled in the art from the description to follow.

SUMMARY OF THE INVENTION

A method and apparatus for automatically controlling integrated circuit supply voltages is described herein. According to one embodiment, the apparatus includes a primary voltage regulator and a secondary voltage regulator. The primary voltage regulator supplies one of either a first voltage or a second voltage to a first plurality of inputs of an integrated circuit. The secondary voltage regulator conditionally supplies a third voltage to a second plurality of inputs of the integrated circuit in the event the primary voltage regulator supplies the first voltage, with the third voltage being substantially the same as the second voltage.

BRIEF DESCRIPTION OF THE DRAWINGS

The present invention is illustrated by way of example and not limitation in the figures of the accompanying drawings, in which like references indicate similar elements and in which.

DETAILED DESCRIPTION

In the following detailed description numerous specific details are set forth in order to provide a thorough understanding of the present invention. However, it will be understood by those skilled in the art that the present invention may be practiced without these specific details. In other instances, well known methods, procedures, components, and circuits have not been described in detail so as not to obscure aspects of the present invention.

In the descriptions which follow reference is made to signals being in a high state or a low state. A signal in a low state typically represents a voltage of between 0.0 and 0.8 volts. A signal in a high state typically represents a voltage of between 2.0 and 5.0 volts. It is to be appreciated, however, that the voltages which represent a low state or a high state can be different than the ranges mentioned above.

In the descriptions which follow reference is also made to specific voltage levels. It is to be appreciated that these voltage levels are provided as examples, and that the present invention is not limited to providing these specific voltage levels.

In the descriptions which follow, reference is also made to providing power to a processor. It is to be appreciated that a processor is only one example of an integrated circuit (IC) which may be used with the present invention and that any of a wide variety of conventional ICs can be used with the present invention.

The present invention provides a mechanism for automatically supplying the proper voltages to a variety of different chips which can be mounted on a circuit board. The present invention provides the correct voltage(s) to chips with inputs that require the same voltage, or inputs that require different voltages. The present invention provides the proper voltage(s) for these different chips automatically, without requiring additional configuration of the circuit board by a user.

Figure 1:
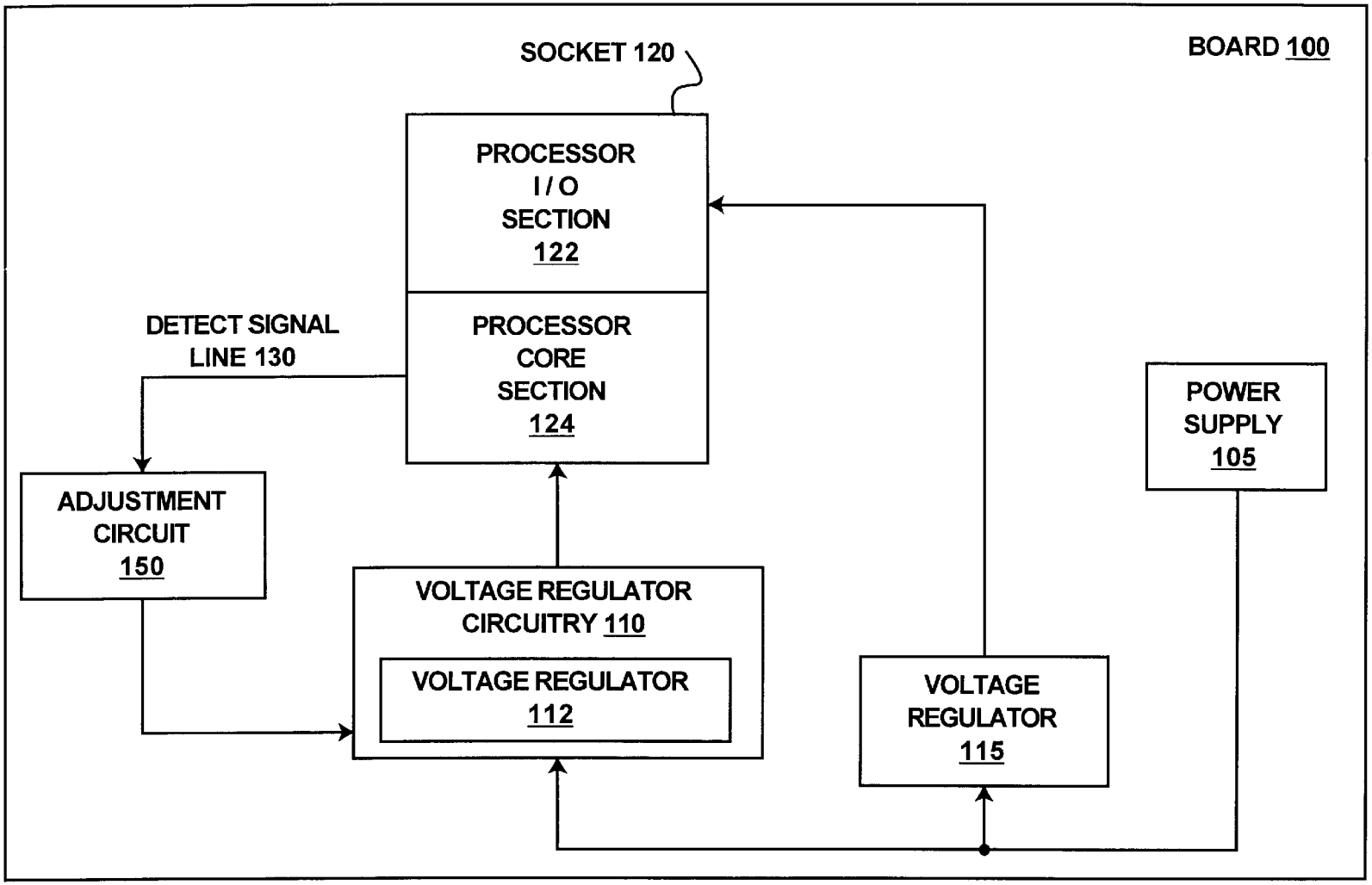
FIG. 1 is a block diagram showing a circuit board incorporating one embodiment of the present invention.

FIG. 1 is a block diagram showing a circuit board incorporating one embodiment of the present invention. A circuit board 100 is shown including a power supply 105, voltage regulator circuitry 110, a voltage regulator 115, an adjustment circuit 150, and a socket 120. The voltage regulator circuitry 110 includes a voltage regulator 112 as shown. The power supply 105 is a conventional power supply for generating power to the various components of the board 100. In one embodiment, the power supply 105 provides 5 volts to each of the regulators 112 and 115. Additionally, the power supply 105 may also provide 5 volts or 3.3 volts to other components of the board 100. These additional components have not been shown so as not to clutter the drawings and obscure the present invention.

The socket 120 denotes an area on the board 100 where an IC (e.g., a processor) can be attached to the board 100. In one embodiment, the socket 120 is a conventional socket including multiple receptacles or holes for the pins of a processor. Some of the receptacles or holes are electrically connected to the voltage regulators 112 and 115. In this embodiment, the pins of the processor are inserted into the receptacles of the socket 120, thereby placing the power pins of the processor in electrical contact with the voltage regulators 112 and 115.

It is to be appreciated, however, that an IC can be mounted to the board 100 in any of a wide variety of conventional manners. For example, in one alternate embodiment, the socket 120 is replaced by an area having multiple electrical conductors electrically connected to the voltage regulators 112 and 115, and the processor can be surface-mounted to the board 100 in a conventional manner. The surface-mounting of the processor places the inputs of the processor in direct electrical contact with the electrical conductors, thereby placing the inputs of the processor in electrical contact with the voltage regulators 112 and 115. Examples of these electrical conductors include a land grid array and the like.

The socket 120 is separated into two different portions, shown as the processor input/output (I/O) section 122 and the processor core section 124. Each of the I/O section 122 and the core section 124 receives power from voltage regulator 115 and/or voltage regulator circuitry 110, as discussed in more detail below. The I/O section 122 and the core section 124 provide the voltage supplies to the processor which will be coupled to the socket 120. It is to be appreciated that additional inputs and outputs (not shown) can also be coupled to the board 100 for the transfer of data, address and control information. The exact types and numbers of additional inputs and outputs is dependent on the nature of the chip (e.g., processor, memory controller, I/O controller, etc.) being coupled to the socket 120, as is well known to those skilled in the art.

In the embodiment shown in FIG. 1, it is presumed that the power inputs to the processor which is to be coupled to the socket 120 are separated into two different portions: the processor I/O section power inputs and the processor core section power inputs. The processor I/O section refers to the portion of the processor which provides and controls the input and output of data, address and control signals to and from the processor. The processor core section refers to the portion of the processor which controls and performs the internal processor functions (for example, the execution unit(s), decoder(s), buffer(s), etc. in the processor).

The I/O section 122 of the socket 120 provides the voltage supply to the I/O section of the processor. Similarly, the core section 124 of the socket 120 provides the voltage supply to the processor core of the processor.

The board 100 supports different possibilities for voltage supply requirements for the processors which can be inserted into the socket 120. According to one embodiment, three different possibilities exist. First, the I/O section inputs and the core section inputs for the processor may require the same voltage and may further be connected together internally on the chip. This situation is referred to as a "unified plane". One example of a chip having a unified plane is an Intel Pentium® processor (Model P54C). Second, the I/O section inputs and the core section inputs for the chip may require the same voltage but be separated on the chip. This situation is referred to as a "split plane/same voltage". One example of a split plane/same voltage chip is an Intel Pentium® OverDrive® processor (Model P54CTB). Third, the I/O section inputs and the core section inputs may require different voltages. This situation is referred to as a "split plane/different voltage". One example of a split plane/different voltage chip is an Intel Pentium® processor (Model P55C).

The two voltage regulators 112 and 115 supply the power to the socket 120. The voltage regulator 115 is coupled to the I/O section 122 as shown. Similarly, the voltage regulator 112 is coupled to the core section 124 as shown. According to one embodiment of the present invention, the regulator 115 is a small linear regulator capable of providing 800 milliamps of current at 3.3 volts and the regulator circuitry 110, which includes a large linear regulator as regulator 112, is capable of providing 5 amps of current at either 2.8 volts or 3.5 volts. In one implementation, the voltage regulator 115 is an EZ1117CST-3.3 voltage regulator, available from Semtech Corporation of Newbury Park, Calif., and the voltage regulator 112 is an LT1585ACT voltage regulator, available from Linear Technology Corporation of Milpitas, California. However, it is to be appreciated that any of a wide variety of voltage regulators can be used with the present invention. It is also to be appreciated that the voltage levels supplied in accordance with the present invention can be changed by changing the voltage regulators being used. It should also be noted that the voltage levels supplied by the regulator circuitry 110 can be changed by changing the values of various resistors which are part of the voltage regulator circuitry 110, as discussed in more detail below with reference to FIG. 2.

The voltages supplied to the socket 120 by the regulator circuitry 110 and regulator 115 are dependent on whether the processor coupled to socket 120 is a unified plane, split plane/same voltage, or split plane/different voltage chip. The voltages provided in these three situations according to one embodiment of the present invention are summarized below in Table 1, in which Regulator(1) refers to regulator circuitry 110 and Regulator(2) refers to the voltage regulator 115.

TABLE I

| Chip | Regulator (1) | Regulator (2) |
|---|---|---|
| Unified Plane | 3.5v | Off |
| Split Plane/Same Voltage | 3.5v | 3.3v |
| Split Plane/Different Voltage | 2.8v | 3.3v |

In one embodiment of the present invention, the voltage at which the regulator circuitry 110 provides current is dependent on the detect signal line 130. If the detect signal line 130 is at a first voltage level (e.g., at 0.7 volts), then the regulator circuitry 110 provides current at 3.5 volts. However, if the detect signal line 130 is at a second voltage level (e.g., at 0.0 volts), then the regulator circuitry 110 provides current at 2.8 volts.

In one embodiment, chips used with the present invention include an additional pin which is coupled to the detect signal line 130 when the chip is mounted on the board 100. This pin is tied to a particular voltage level (e.g., to ground) within the chip if the chip is a split plane/different voltage chip. For other types of chips, the pin is not connected to any ground or voltage source within the chip (referred to as a "no connect").

Additionally, adjustment circuitry 150 is coupled to the detect signal line 130. If a split plane/different voltage chip is inserted, then the grounding of the output signal forces the detect signal line 130 to a voltage of zero volts. If, however, a split plane/same voltage chip is inserted, then the adjustment circuitry 150 pulls the detect signal line 130 to a higher voltage level. The adjustment circuitry 150 affects which voltage is supplied by the voltage regulator 110 based on which voltage level the detect signal line 130 is at. The adjustment circuitry 150 is discussed in more detail below with reference to FIG. 2.

In one embodiment of the present invention, chips other than split plane/different voltage chips do not include the additional pin to be coupled to the detect signal line 130. Thus, when such a chip is mounted to the socket 120, there is no connection for the detect signal line 130, and the adjustment circuitry 150 forces the detect signal line 130 to the higher voltage level.

One characteristic of the voltage regulator 115 is that the regulator 115 stops outputting current (e.g., "shuts off") if a voltage is applied to the output of the regulator 115 which is higher than the voltage being output by the regulator 115. Therefore, if the chip mounted in the socket 120 is a unified plane chip, then the regulator circuitry 110 provides 3.5 volts, and the voltage regulator 115 begins to provide 3.3 volts. However, because the power inputs within the chip are tied together, the regulator circuitry 110 provides 3.5 volts to the inputs which are part of the I/O section 122. In response to the larger voltage on its output, the regulator 115 shuts off. Thus, in a system using a unified plane chip, the voltage regulator 115 turns off, and the entire chip is powered by the voltage regulator 112. Additionally, in a unified plane chip, if the voltage at the inputs were to ever drop below the voltage output of the regulator 115 (e.g., 3.3 volts), then the regulator 115 would turn back on.

Figure 2:
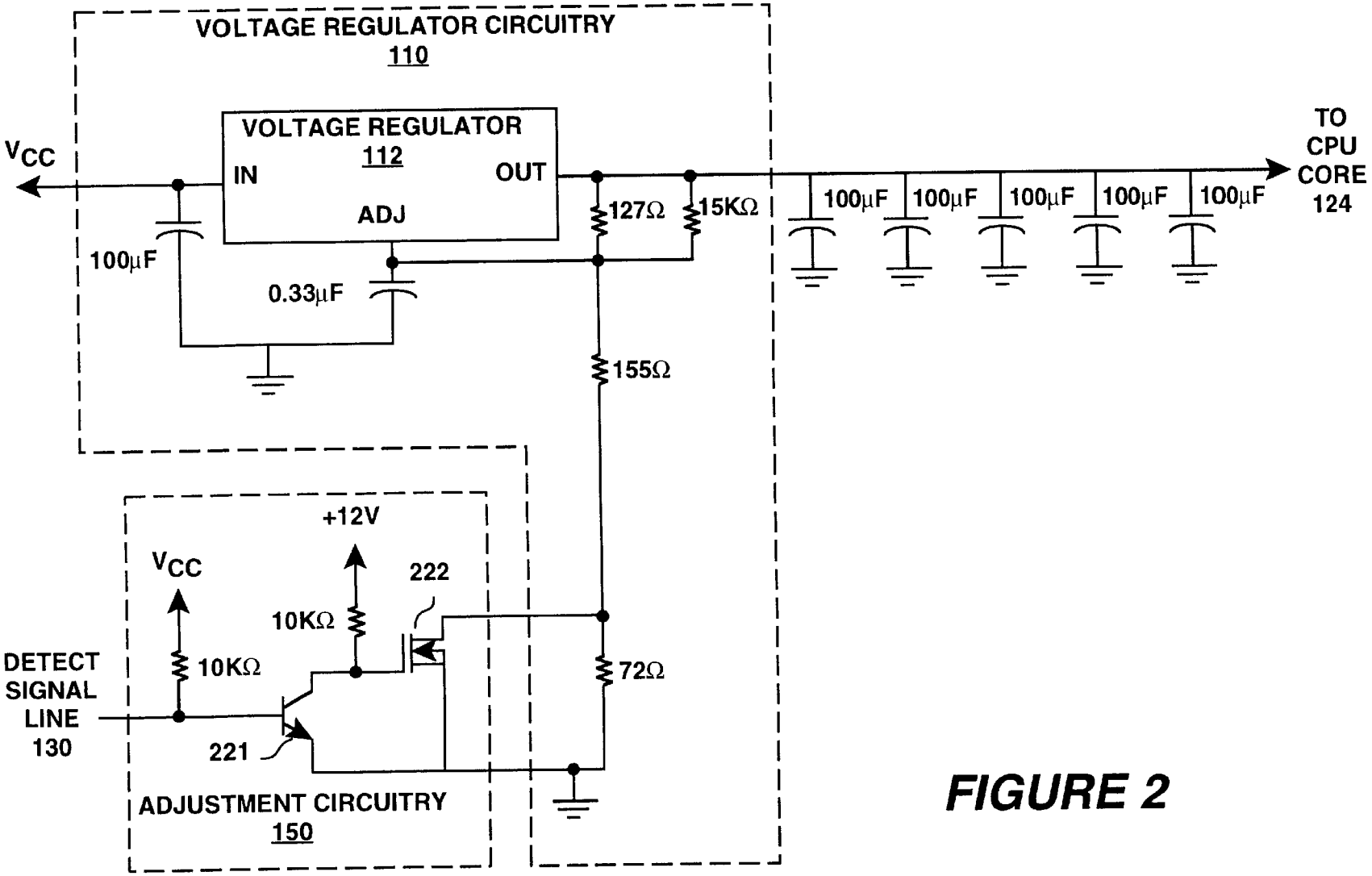
FIG. 2 is a circuit diagram showing a regulator and associated circuitry in more detail according to one embodiment of the present invention.

FIG. 2 is a circuit diagram showing the regulator 112 and associated circuitry in more detail according to one embodiment of the present invention. $V_{CC}$ is shown as coupled to the circuitry in FIG. 2. In one embodiment, $V_{CC}$ is the voltage supplied by power supply 105 of FIG. 1.

As shown in FIG. 2, the voltage regulator 110 has a voltage input (IN), a voltage output (OUT), and an adjustment pin (ADJ). The voltage output by the voltage regulator 112 is dependent on the adjustment pin. The adjustment pin of the voltage regulator 112 is coupled to adjustment circuitry 150 as shown.

The adjustment circuitry 150 includes two transistors 221 and 222 as shown. In one embodiment, the transistor 221 is a bipolar junction transistor (BJT), part number MMBT3904 available from National Semiconductor, Inc. of Santa Clara, Calif., and the transistor 222 is an n-channel field effect transistor (FET), part number MMBF170, also available from National Semiconductor, Inc.

It is to be appreciated that the adjustment circuitry 150 is only an example of circuitry which can be used on the detect signal line 130. Any of a wide variety of conventional circuitry can be used as adjustment circuitry on the detect signal line 130.

The output of the regulator circuitry 110 is dependent on its input voltage and the voltage at the adjustment pin (ADJ) of the voltage regulator 112. The adjustment circuitry 150, which is coupled to the ADJ pin as shown, outputs 0.0 volts if the detect signal line 130 is grounded, and outputs 0.7 volts if the detect signal line 130 is not grounded. These two voltage levels of the detect signal line 130 cause the regulator circuitry 110 to output either 2.8 volts or 3.5 volts, respectively, to the core section 124.

It is to be appreciated that the voltage provided by the regulator circuitry 110 can be changed to other than the 2.8/3.5 volts in order to accommodate different chips. This can be accomplished in a wide variety of conventional manners. For example, the resistance values of the resistors shown in FIG. 2 can be changed. Alternatively, a different adjustment circuit 150 could be provided which has a voltage output different from the 0.0/0.7 volts discussed above. Or, alternatively, the voltage regulator 112 itself could be replaced with a different voltage regulator.

Figure 3:
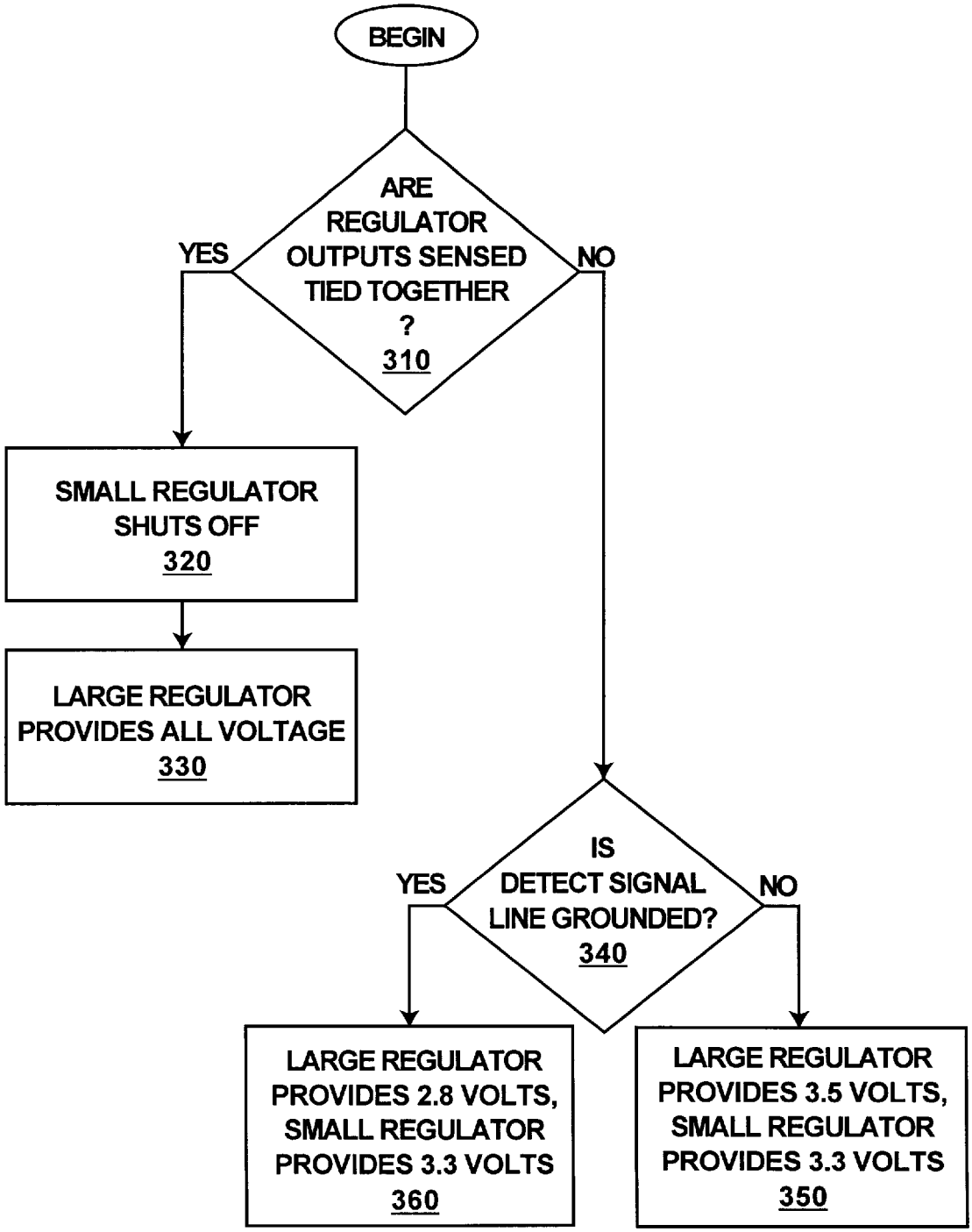
FIG. 3 is a flowchart showing the supply voltages of two voltage regulators according to one embodiment of the present invention.

FIG. 3 is a flowchart showing the supply voltages of two voltage regulators according to one embodiment of the present invention. When power is supplied to the system, the small regulator 115 senses whether its output is tied to the output of the regulator circuitry 110, block 310. If the outputs are sensed tied together, then the small regulator 115 turns off, block 320, and the regulator circuitry 110 supplies voltage (e.g., 3.5 volts) to the entire chip, block 330. However, if the outputs are not sensed tied together, then the voltage supplied by the regulator circuitry 110 is dependent on whether the detect signal line is grounded, block 340. If the detect signal line is not grounded, then the regulator circuitry 110 provides 3.5 volts to the core section and the small regulator 115 provides 3.3 volts to the I/O section, block 350. However, if the detect signal is grounded, then the regulator circuitry 110 provides 2.8 volts to the core section and the small regulator 115 provides 3.3 volts to the I/O section, block 360.

It is to be appreciated that the provision of the power supply voltages is an automatically occurring event which occurs whenever the voltage level of the detect signal line changes and whenever the regulator outputs being tied together changes. These aspects will generally change only when the chip connected to socket 120 is changed. Typically, chips are changed on a circuit board only after power to the board is turned off. However, if a chip were to be replaced while power was being supplied to the circuit board, then the present invention would automatically repeat the steps shown in FIG. 3 upon insertion of the new chip.

Figure 4:
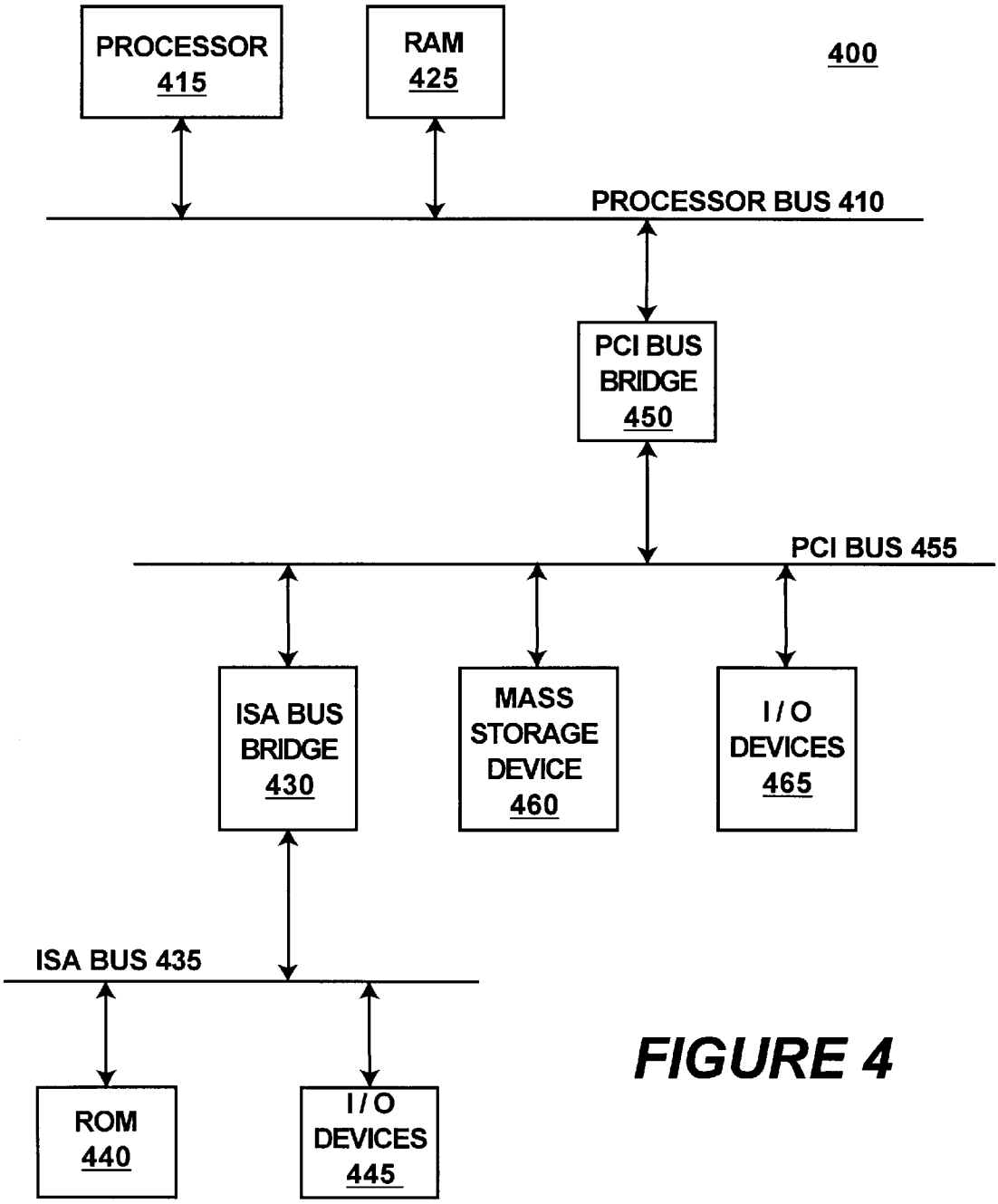
FIG. 4 is a block diagram of a computer system such as may be used with the present invention.

FIG. 4 is a block diagram of a computer system such as may be used with the present invention. A system 400 is shown comprising a processor bus or other communication device 410 for communicating information to and from the processor 415. The processor 415 is for processing information and instructions. In one implementation, the present invention includes an Intel® architecture microprocessor as the processor 415; however, the present invention may utilize any type of microprocessor architecture. In one embodiment, the processor bus 410 includes address, data and control buses. The system 400 also includes a random access memory (RAM) 425 coupled with the processor bus 410 for storing information and instructions for the processor 415.

A bridge is also coupled to the processor bus 410 for coupling the processor bus 410 to one or more additional, typically I/O, buses. In one embodiment, this bus is the Peripheral Component Interconnect (PCI) bus 455. The PCI bus bridge 450 couples the processor bus 410 to the PCI bus 455. A mass storage device 460 such as a magnetic or optical disk and disk drive is coupled with the PCI bus 455 for storing information and instructions for the processor 415. I/O devices 465 are also coupled to the PCI bus 455 which input and output data and control information to and from the processor 415. The I/O devices 465 can include, for example, a display device, an alphanumeric input device including alphanumeric and function keys, and a cursor control device. A hard copy device such as a plotter or printer may also be included in the I/O devices 465 for providing a visual representation of computer images, or a network adapter device may be included in the I/O devices 465 for coupling the system 400 to a computer network, such as a Local Area Network (LAN).

In one embodiment, the PCI bus 455 is also coupled to an Industry Standard Architecture (ISA) bus 435 via an ISA bus bridge 430. A read only memory (ROM) 440 is coupled with the ISA bus 435 for storing static information and instructions for the processor 415. I/O devices 445 are also coupled to the ISA bus 435 which input and output data and control information to and from the processor 415. These devices can include the same types of devices as can be included in I/O devices 445 discussed above.

In one embodiment of the present invention, the buses 410, 435, and 455, the bridges 430 and 450, and the processor 415 are mounted on the same circuit board, referred to as a "motherboard". Additional devices may also be mounted directly on the motherboard (e.g., ROM 440 or controller(s) for I/O devices 445 or 465). A motherboard typically includes multiple slots which are receptacles for additional circuit boards. These additional circuit boards can be plugged into the available slots on the motherboard, thereby allowing the processor 415 to communicate with the chips on these additional circuit boards. These additional circuit boards can include, for example, circuit boards with RAM 425 mounted thereto, or connections (e.g., ports) for I/O devices 445. In one implementation, all of the components within system 400 receive power from the same source (e.g., power supply 105 of FIG. 1).

It is to be appreciated that certain implementations of the system 400 may include additional processors or other components. Furthermore, certain implementations of the present invention may not require nor include all of the above components. For example, I/O devices 445 or 465 may not include a display device. Alternatively, the system 400 may not include an ISA bus 435 and ISA bus bridge 430.

It is to be appreciated that although the above descriptions discuss a single chip on a circuit board being powered by the present invention, additional chips or circuits may also be powered on the circuit board in accordance with the present invention. These additional chips or circuits may be powered by the same two voltage regulators discussed above, or alternatively may be powered by an additional pair of voltage regulators analogous to regulators 112 and 115 discussed above.

It is also to be appreciated that although the description above discusses chips with power inputs driven by either the same voltage or two different voltages, additional voltages may also be supported. For example, a chip which requires three different supply voltages could be powered by the present invention by adding an additional small regulator to provide the proper third voltage. Chips requiring more than three different supply voltages could be powered by adding additional small regulators to provide the additional voltages, analogous to the regulator 115 of FIG. 1.

Whereas many alterations and modifications of the present invention will be comprehended by a person skilled in the art after having read the foregoing description, it is to be understood that the particular embodiments shown and described by way of illustration are in no way intended to be considered limiting. References to details of particular embodiments are not intended to limit the scope of the claims.

Thus, a method and apparatus for automatically controlling integrated circuit supply voltages has been described.

What is claimed is:

1. An apparatus comprising:

a primary voltage regulator for supplying a selected one of a first and a second voltage to an integrated circuit; and a secondary voltage regulator for conditionally supplying a third voltage to the integrated circuit in view of one or more conditions, including a first condition associated with an electrical characteristic of the integrated circuit.

2. The apparatus of claim 1, further comprising a detect signal line denoting said electrical characteristic of the integrated circuit wherein the primary voltage regulator supplies the first voltage responsive to the detect signal line being at a first voltage level denoting a first configuration of said electrical characteristic and supplies the second voltage responsive to the detect signal line being at a second voltage level denoting a second configuration of said electrical characteristic.

3. The apparatus of claim 2, further comprising an adjustment circuit, coupled to the detect signal line, for outputting one of either a fourth voltage or a fifth voltage to the primary voltage regulator responsive to a voltage level of the detect signal line.

4. The apparatus of claim 1, wherein the secondary voltage regulator does not supply the third voltage to the integrated circuit when a first plurality of input pins of the integrated circuit are connected within the integrated circuit to a second plurality of input pins of the integrated circuit.

5. The apparatus of claim 1, wherein the one or more conditions on which the secondary voltage regulator supplies the third voltage to the integrated circuit include a second condition associated with whether the first or second voltage is supplied by the first voltage regulator.

6. The apparatus of claim 1, wherein the secondary voltage regulator supplies the third voltage the the integrated circuit when a first plurality of input pins of the integrated circuit are not connected within the integrated circuit to a second pluratity of input pins of the integrated circuit.

7. A system comprising:

a circuit board, the circuit board comprising an area for attaching an integrated circuit to the circuit board;

a detect signal line coupled to the circuit board;

an adjustment circuit coupled to the circuit board and the detect signal line for generating one of either a first voltage or a second voltage responsive to a voltage level of the detect signal line;

a first voltage regulator, coupled to the circuit board and the adjustment circuit, for providing a third voltage to the area responsive to the adjustment circuit generating the first voltage, and for providing a fourth voltage to the area responsive to the adjustment circuit generating the second voltage; and a second volatage regulator for conditionally supplying a fifth voltage to the area in view of one or more conditions, including a first condition associated with an electrical characteristic of the integrated circuit.

8. The system of claim 7, wherein the area comprises a socket having a plurality of receptacles for receiving a plurality of pins of the integrated circuit.

9. The system of claim 7, wherein the integrated circuit comprises a processor.

10. The system of claim 7, wherein the second voltage regulator is for providing the fifth voltage to a first portion of the area, and wherein the first voltage regulator is also for providing either the third voltage or the fourth voltage to a second portion of the area.

11. The system of claim 10, wherein the first portion corresponds to a processor input/output section of the integrated circuit and the second portion corresponds to a processor core section of the integrated circuit.

12. The system of claim 7, wherein the second voltage regulator provides no voltage to the area responsive to a first portion of the area being connected to a second portion of the area through the integrated circuit.

13. The system of claim 7, wherein the one or more conditions on which the secondary voltage regulator supplies the fifth voltage to the area include a second condition associated with whether the third or the fourth voltage is supplied by the first voltage regulator.

14. The system of claim 7, wherein the secondary voltage regulator supplies the fifth voltage to the area responsive to a first portion of the area not connected through the integrated circuit to a second portion of the area.

15. A method comprising:

(a) checking a signal to determine whether the signal is in a first state or a second state;

(b) providing a first chip supply voltage by a first voltage regulator at a first voltage level to a chip responsive to the signal being in the first state, and providing the first chip supply voltage by the first voltage regulator at a second voltage level to the chip responsive to the signal being in the second state; and (c) conditionally supplying a second chip supply voltage by a second voltage regulator at a third voltage to the chip in view of one or more conditions, including a first condition associated with an electrical characteristic of the chip.

16. The method of claim 15, wherein the providing of (b) comprises providing either the first voltage or the second voltage to a first set of one or more inputs of a processor.

17. The method of claim 15, wherein the supplying of (c) comprises providing the second chip supply voltage to a second set of one or more inputs of the chip.

18. The method of claim 15, further comprising shutting off the second voltage regulator responsive to the output of the first voltage regulator being coupled within the chip to the output of the second voltage regulator.

19. The method of claim 18, further comprising providing the second voltage by the first voltage regulator to both a first set of one or more inputs of the chip and a second set of one or more inputs of the chip.

20. The method of claim 15, wherein the one or more conditions further include a second condition associated with which voltage being said first supply voltage is supplied by the first regulator.

21. The method of claim 15, wherein the second voltage regulator supplies the second chip supply voltage at the third voltage to the chip responsive to an output of the first voltage regulator being not coupled through the chip to an output of the second voltage regulator.

* * * * *

UNITED STATES PATENT AND TRADEMARK OFFICE

CERTIFICATE OF CORRECTION

PATENT NO. : 5,939,868
APPLICATION NO. : 09/115108
DATED : August 17, 1999
INVENTOR(S) : Hall et al.

It is certified that error appears in the above-identified patent and that said Letters Patent is hereby corrected as shown below:

In column 8, at line 42, delete the second occurrence of "the" and insert --to--.

Signed and Sealed this

Thirty-first Day of July, 2007

JON W. DUDAS
*Director of the United States Patent and Trademark Office*